US011167283B2

(12) United States Patent
Wolf et al.

(10) Patent No.: US 11,167,283 B2
(45) Date of Patent: Nov. 9, 2021

(54) DOT BLOT BOX AND USE THEREOF

(71) Applicant: UNIVERSITY OF SOUTH CAROLINA, Columbia, SC (US)

(72) Inventors: Lauren M. Wolf, Irmo, SC (US); Melissa A. Moss, Columbia, SC (US)

(73) Assignee: University of South Carolina, Columbia, SC (US)

( * ) Notice: Subject to any disclaimer, the term of this patent is extended or adjusted under 35 U.S.C. 154(b) by 145 days.

(21) Appl. No.: 16/357,681

(22) Filed: Mar. 19, 2019

(65) Prior Publication Data

US 2019/0336966 A1 Nov. 7, 2019

Related U.S. Application Data

(60) Provisional application No. 62/666,743, filed on May 4, 2018.

(51) Int. Cl.
*B01L 9/00* (2006.01)
*B01L 3/00* (2006.01)

(52) U.S. Cl.
CPC ..... *B01L 3/5023* (2013.01); *B01L 9/52* (2013.01); *B01L 2200/025* (2013.01); *B01L 2300/0609* (2013.01); *B01L 2300/0825* (2013.01)

(58) Field of Classification Search
CPC .. B01L 3/5023; B01L 9/52; B01L 2300/0825; B01L 2300/0609; B01L 2200/025
See application file for complete search history.

(56) References Cited

U.S. PATENT DOCUMENTS

| | | | |
|---|---|---|---|
| 5,059,522 | A | 10/1991 | Wayne |
| 6,130,099 | A | 10/2000 | Kielmann |
| 7,270,800 | B2 | 9/2007 | Klunk et al. |
| 7,351,401 | B2 | 4/2008 | Klunk et al. |
| 7,854,920 | B2 | 12/2010 | Klunk et al. |
| 2002/0009328 | A1 | 1/2002 | Beckman et al. |
| 2002/0115223 | A1 | 8/2002 | Tanzi et al. |
| 2011/0257407 | A1 | 10/2011 | Klunk et al. |

(Continued)

FOREIGN PATENT DOCUMENTS

| | | |
|---|---|---|
| CN | 201926662 | 8/2011 |
| CN | 201926664 | 8/2011 |

(Continued)

OTHER PUBLICATIONS

Millipore Corporation. "Protein Blodinoz, Applications Guide" (1997).

(Continued)

*Primary Examiner* — Matthew D Krcha
*Assistant Examiner* — Sophia Y Lyle
(74) *Attorney, Agent, or Firm* — Dority & Manning, P.A.

(57) ABSTRACT

Devices (dot blot boxes) for use in immunoblotting are described. The dot blot boxes can include a series of hooks, clips or the like on opposite sides of a container for retaining a test strip there between. The dot blot boxes can be sized to retain a plurality of test strips generally parallel to one another such that they do not contact one another and do not contact the base of the container. A container can hold a fluid, e.g., a blocking buffer solution or antibody solution, and the test strips can be submerged in the fluid while retained in the container.

14 Claims, 8 Drawing Sheets

(56) References Cited

U.S. PATENT DOCUMENTS

| | | | |
|---|---|---|---|
| 2012/0095235 | A1 | 4/2012 | Klunk et al. |
| 2012/0269738 | A1 | 10/2012 | Yang et al. |
| 2013/0017615 | A1 | 1/2013 | Kim et al. |

FOREIGN PATENT DOCUMENTS

| | | | | |
|---|---|---|---|---|
| CN | 102435732 | | 5/2012 | |
| DE | 4201988 | | 7/1993 | |
| DE | 10061352 | | 6/2002 | |
| DE | 10061352 | A1 * | 6/2002 | ..... G01N 33/5302 |
| DE | 20215268 | U1 * | 4/2003 | ..... G01N 33/545 |
| DE | 202012004404 | U1 * | 6/2012 | ..... B01L 3/50855 |
| EP | 3025779 | A1 * | 6/2016 | ..... B01L 3/50855 |
| UA | 56820 | | 1/2011 | |
| WO | WO-9423326 | A1 * | 10/1994 | ..... G02B 21/34 |
| WO | WO 94/25874 | | 11/1994 | |
| WO | WO 00/43791 | | 7/2000 | |
| WO | WO 02/088732 | | 11/2002 | |
| WO | WO-2007126506 | A2 * | 11/2007 | ..... G01N 33/569 |

OTHER PUBLICATIONS

Nag, et al. "Nature of the Amyloid-β Monomer and the Monomer-Oligomer Equilibrium" *J. Biol. Chem*. 286 (2011) pp. 13827-13833.
Stine, et al. "In Vitro Characterization of Conditions for Amyloid—Peptide Oligomerization and Fibrillogenesis" *J Biol. Chem*. 278(13) (2003) pp. 11612-11622.
Towbin, et al. "Electrophoretic transfer of proteins from polyacrylamide gels to nitrocellulose sheets: Procedure and some applications" *Proc Natl Acad Sci USA* 76(9) (1979) pp. 4350-4354.

* cited by examiner

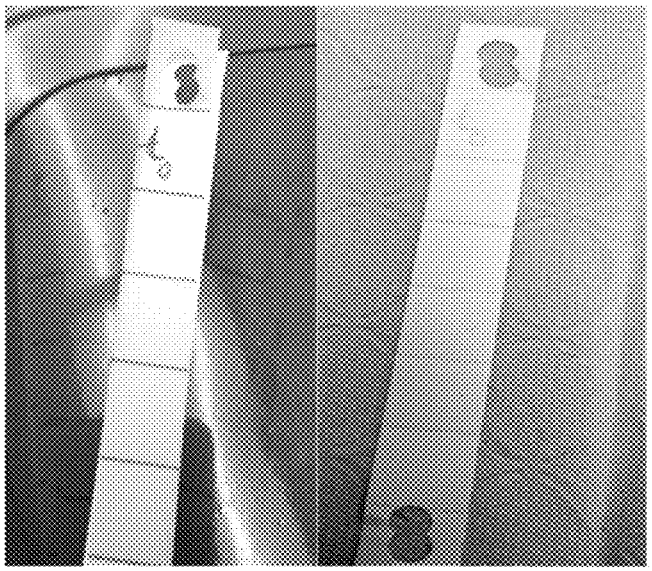
FIG. 14
FIG. 15
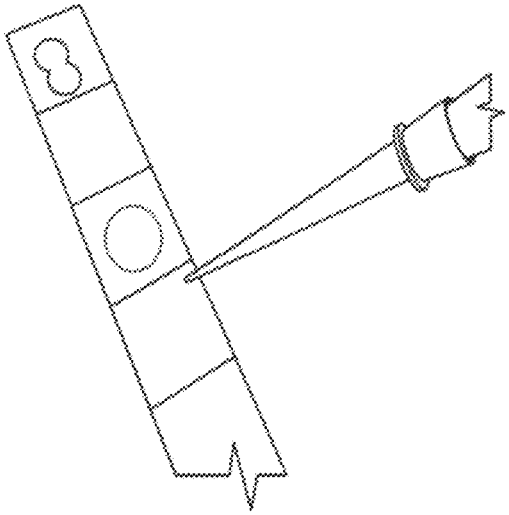
FIG. 16
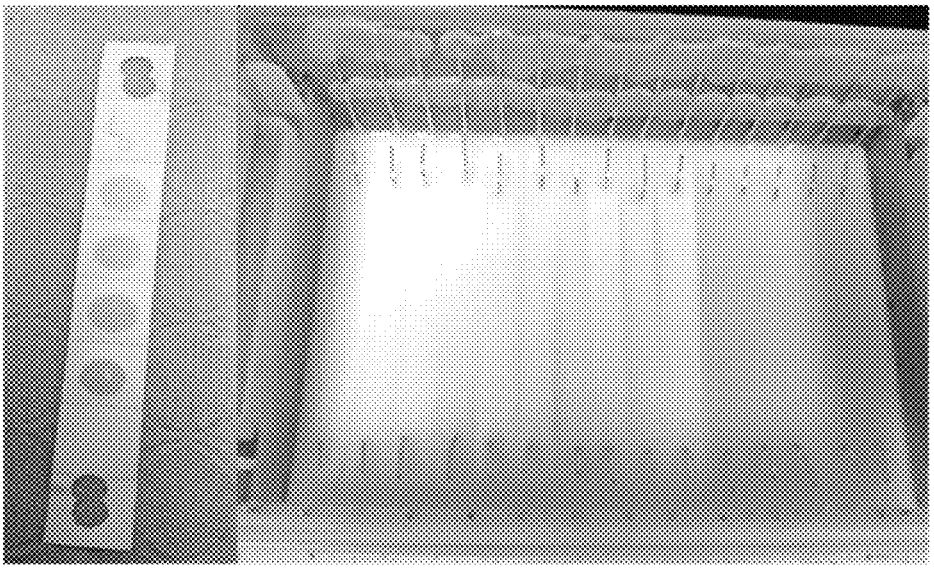
FIG. 17
FIG. 18

DOT BLOT BOX AND USE THEREOF

CROSS REFERENCE TO RELATED APPLICATION

This application claims filing benefit of U.S. Provisional Patent Application Ser. No. 62/666,743, having a filing date of May 4, 2018, which is incorporated herein by reference for all purposes.

BACKGROUND

Protein blotting or 'dot blotting' involves the direct blotting of a sample onto a membrane for the detection and analysis of protein contained in the sample. In essence, the dot blot is a simplification of the Western blot, which, unlike dot blotting, uses electrophoresis to separate proteins by size and/or charge. Dot blotting is a common technique used in molecular biology to detect, analyze, and identify proteins, as it is relatively inexpensive and requires little instrumentation to execute. Beneficially, a dot blot allows for quantitative protein analysis and, when coupled with structural specific antibodies, enables structural visualization.

Unfortunately, potential for error and undesirable expense still exists with dot blotting. For instance, once a sample is dotted, it must be allowed to dry for a brief time (usually 9 to 10 minutes) before it is placed into blocking buffer, which blocks any non-specific binding prior to treatment with primary and secondary antibodies. Something as simple as drying time may compromise the integrity of the blot, especially in those cases in which a researcher is attempting to quantify the amount of a microscopic entity present through immunohistochemistry over an extended time course.

Many researchers use only a small piece of membrane for each dot and rely on copious amounts of each solution/treatment (with associated expense) to ensure equal exposure of the surface area of each dot to blocking buffers and antibodies. Due at least in part to the expense, this strategy is usually reserved for a small number of dots, as a much larger volume of each reagent is required to ensure equivalent exposure of the surface area of each dot to treatment for eventual detection and quantification.

Quantitative time course studies require assessment at many time points and may evaluate the impact of an agent on the aggregation. As such, the number of samples overall that must be evaluated frequently over the course of many hours can be large, adding complexity and expense to dot blot processing. If dots for time course or aggregation studies are made on small membrane fragments, the cost of antibodies, membrane (each fragment requires labeling), and the potential for error through ineffective membrane treatment and assessment due to overlap, inconsistent or incomplete staining, and/or human error such as confusion of the samples becomes much greater. Alternatively, dotting all points onto a larger membrane introduces variation in the drying time of each set of dots, time that can range from minutes to many hours and can yield inconsistent results.

What are needed are devices and methods for use in dot blotting methodologies that can facilitate consistent, accurate results while decreasing both costs and error.

SUMMARY

According to one embodiment, disclosed is a device configured for the execution of protein blocking protocols, i.e., a dot blot box. A dot blot box can include a container and holders located on opposite sides of the container. More specifically, a first holder (e.g., a hook, a clip, a clasp, a pin, etc.) can be located at the inner surface of a first wall of the container and a second holder that can be of the same type or different from the first holder can be located at the inner surface of a second wall of the container that opposes and faces the first wall. The holders can be configured to retain first and second ends of a test strip such that the test strip extends across a width of the dot blot box.

Also disclosed is a method for utilizing the dot blot box. A method can generally include contacting a test strip with a test sample (i.e., dotting the strip) and retaining a first and second end of the test strip by a first and second holder, respectively, of the dot blot box. Thus, the test strip can extend across a width of the container and above the base of the container. The container can also hold a liquid (e.g., a blocking buffer solution, antibody treatment, etc.) and when a test strip is held by the holders, the sample dots on the test strip can be held beneath the surface of the liquid.

A dot blot box can be sized to retain a plurality of test strips. As such, a protocol can be executed using less reagent and, due to the ability for parallel processing of a large number of sample dots, with lower likelihood of error introduction through inconsistent treatment, staining errors, and sample confusion as compared to traditional methods.

BRIEF DESCRIPTION OF THE FIGURES

A full and enabling disclosure of the present subject matter, including the best mode thereof to one of ordinary skill in the art, is set forth more particularly in the remainder of the specification, including reference to the accompanying figures in which:

FIG. 14 illustrates a labeling protocol for a test strip.

FIG. 15 illustrates a test strip following formation and prior to use.

FIG. 16 illustrates sample application (i.e., dotting) on a test strip.

FIG. 17 illustrates a test strip following sample application.

FIG. 18 illustrates several test strips following location in a dot blot box.

Figure 1:
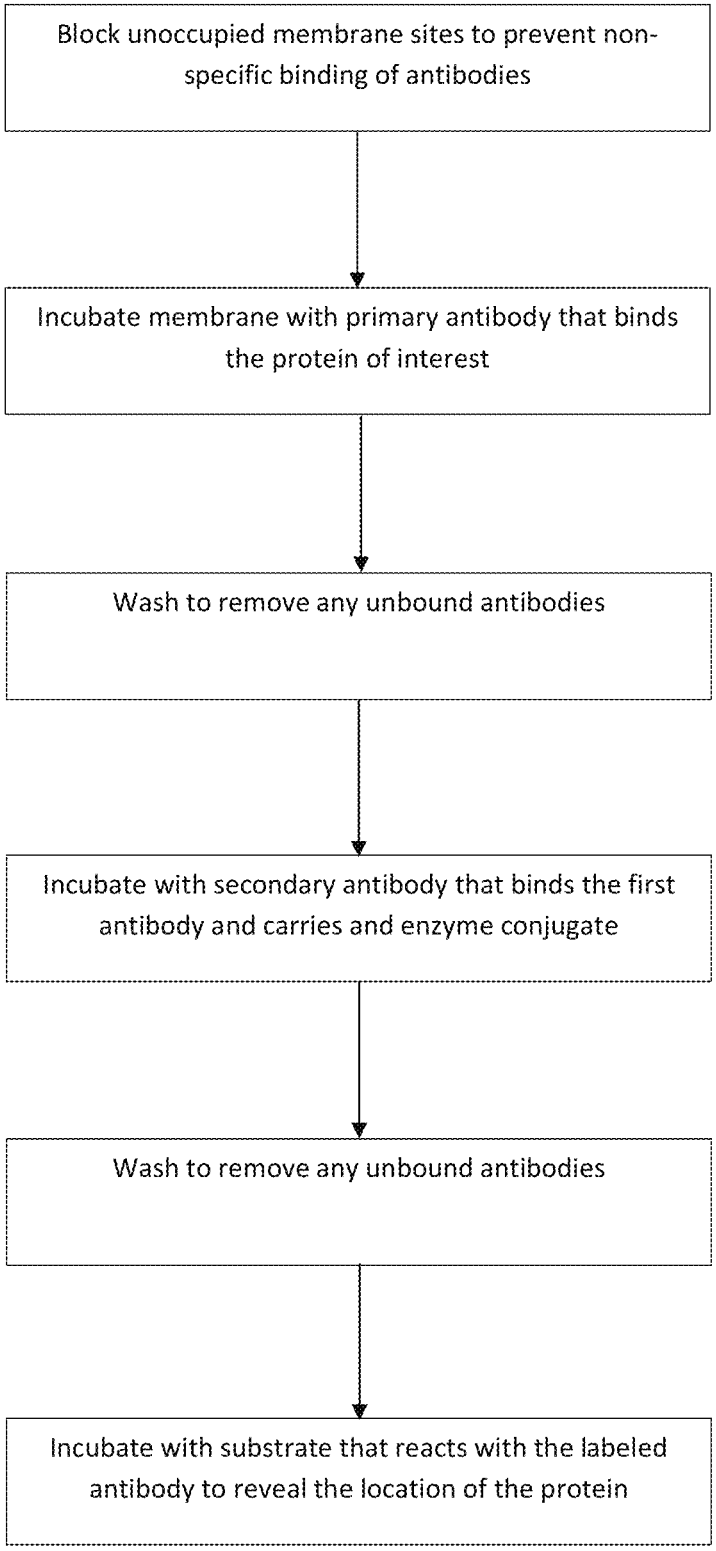
FIG. 1 is a flow diagram for an immunodetection process as may be carried out by use of a dot blot box as disclosed herein.

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made in the present disclosure without departing from the scope or spirit of the subject matter. For instance, features illustrated or described as part of one embodiment, may be used in another embodiment to yield a still further embodiment.

Devices as may be beneficially used in sample blocking and antibody detection protocols are described. The devices are generally referred to throughout this disclosure as dot blot boxes. The dot blot boxes can be easy-to-use and maintain and can provide a route to less expensive protein blotting protocols, particularly in large, complex protocols such as those involving a time course. Beneficially, by use of the dot blot boxes, research facilities can carry out even highly complex protein blot protocols at a much lower cost than by use of traditional methods and systems. Moreover, use of disclosed dot blot boxes can provide more consistency in protein blotting protocols.

The dot blot box can be of particular benefit in terms of both cost and consistency when carrying out complex protocols, e.g., time course studies. Aggregation and accumulation of protein is believed to be present in several disease states including amyloidoses like Alzheimer's disease, in which aggregation and accumulation of the amyloid-β protein is believed to play a role. Observation of protein aggregation requires readings or assessments at many time points, and fluorescence techniques are frequently used to observe the aggregation phenomenon. For instance, Thioflavin-T (ThT) fluorescence is commonly used to examine aggregation of amyloid-β protein in study of Alzheimer's disease. Unfortunately, potential inhibitors of protein aggregation often interfere with fluorescence readings and fluorescence-based techniques do not provide for a closer look at the intermediate structures that dominate each phase of protein aggregation, which can be extremely relevant to the disease pathology. Use of disclosed devices can answer such shortcomings of other observation techniques in an economical and effective fashion.

A dot blot box can be particularly effective for use in a protein blotting protocol, an example of which is described in FIG. 1. As shown, a protocol can include several blocking and incubation steps that each require good contact between the test strip used to carry the protein sample and a reagent of the protocol. A dot blot box as described herein can be utilized in one embodiment in one or more of the blocking and incubation steps in a protocol as described in FIG. 1.

Figure 2:
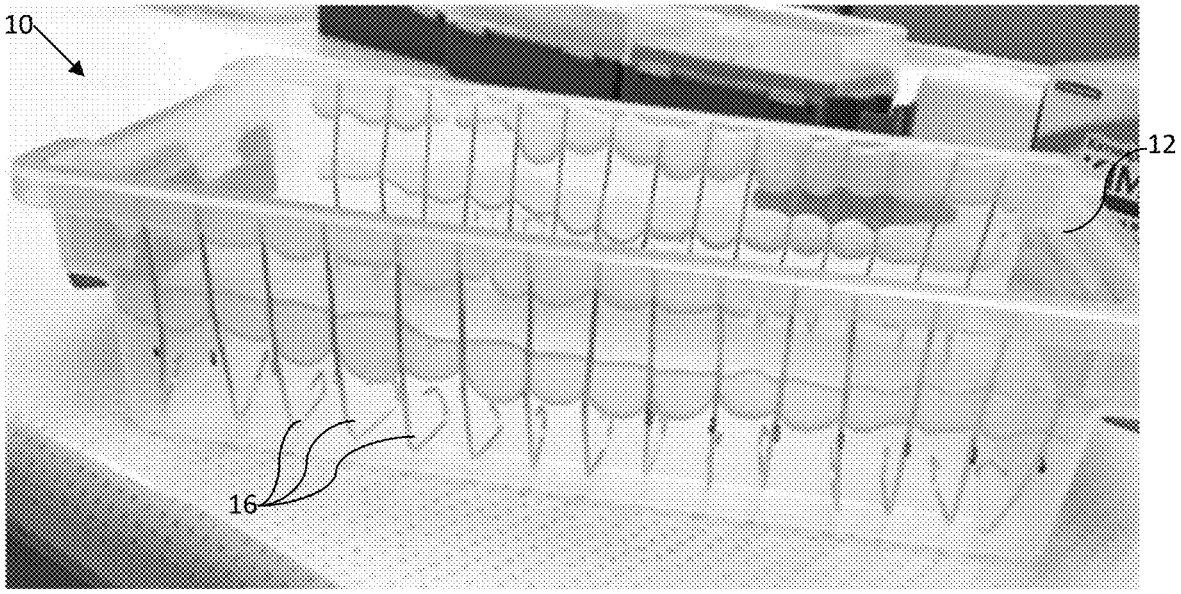
FIG. 2 is a perspective view of one embodiment of a dot blot box.
Figure 3:
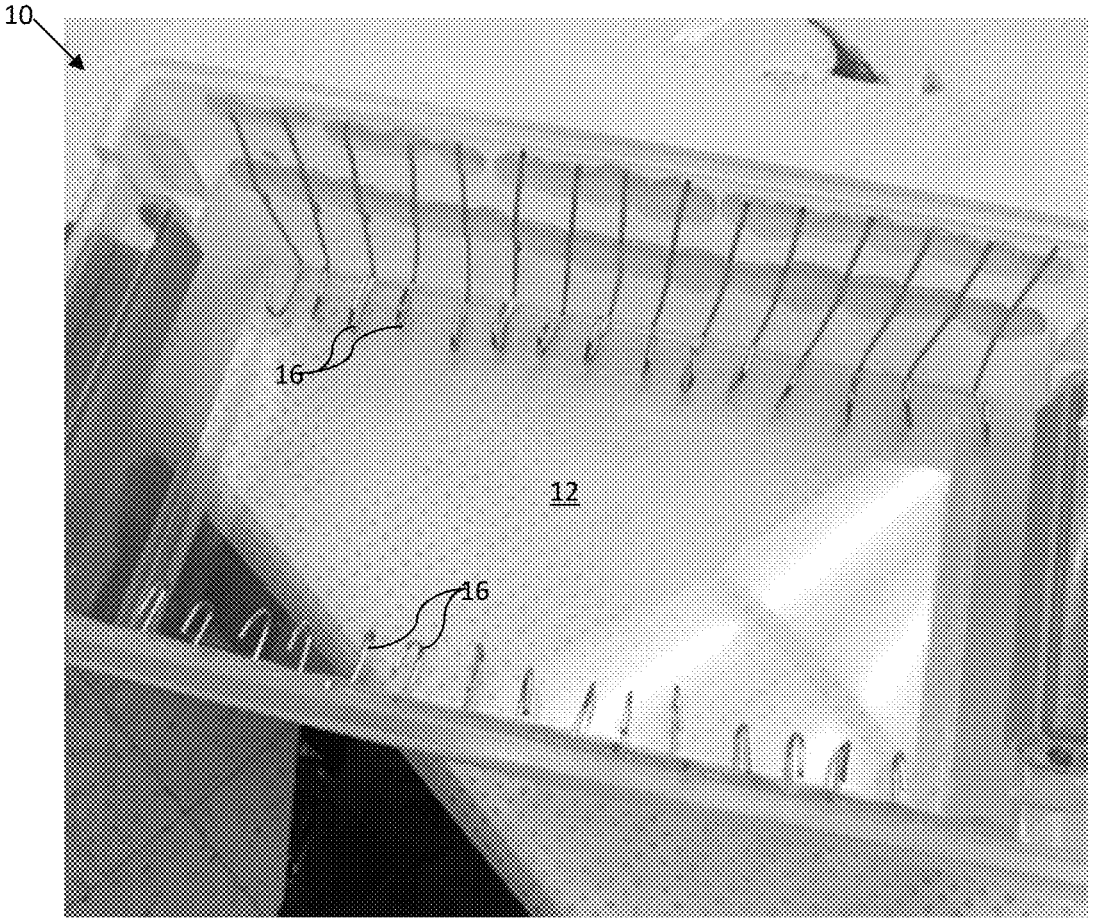
FIG. 3 is a top view of the dot blot box of FIG. 2.
Figure 4:
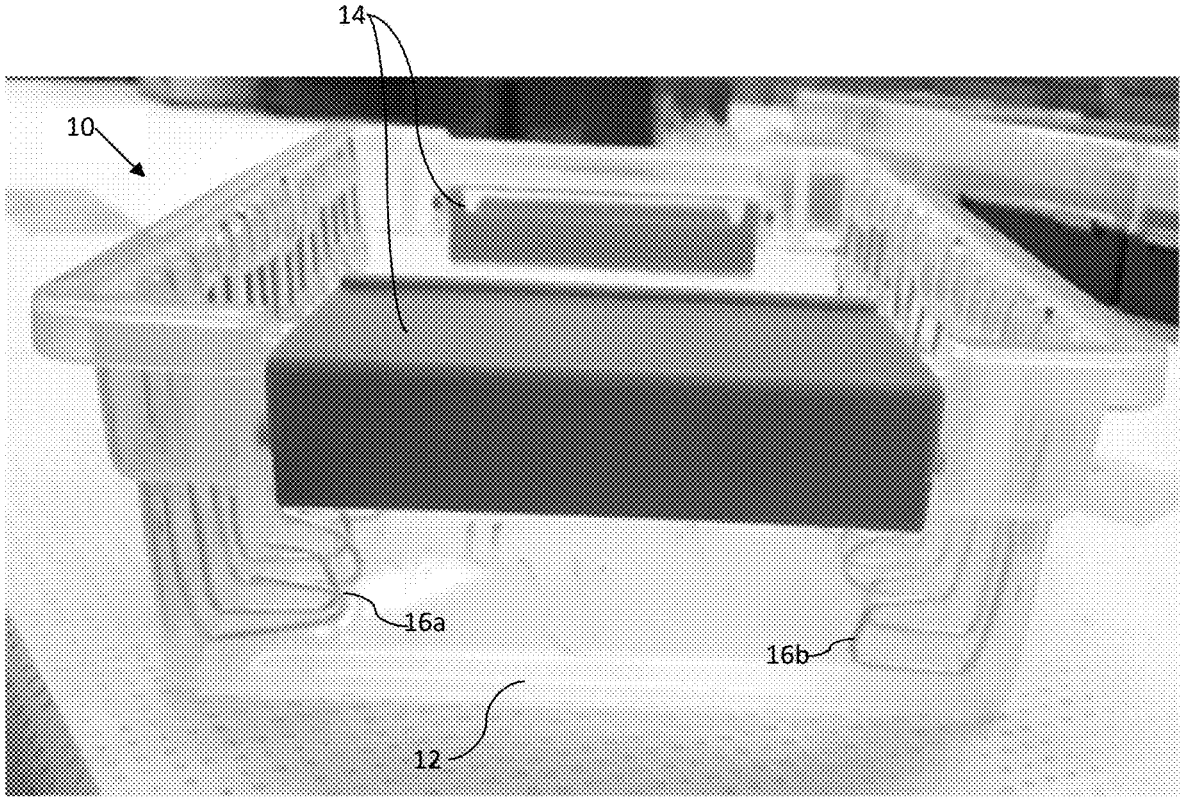
FIG. 4 is an end view of the dot blot box of FIG. 2.

FIGS. 2, 3 and 4 illustrate one embodiment of a dot blot box 10 from a perspective view (FIG. 2), a top view (FIG. 3), and an end view (FIG. 4). The dot blot box 10 includes a container 12 that can have any overall shape, but in general can be a square or rectangular container. The container 12 can be a plastic container, a glass container, or formed of any other suitable material that will be inert to the reagents of a protocol. In one embodiment, the container can include a lid (e.g., a snap-top plastic lid as is known; not shown in the figures) that can temporarily cover the open top of the container 12, for instance during storage. In addition, a container 12 can optionally include handles 14 for easy carrying and that in one embodiment can rotate to lock a lid in place, as is known.

The dot blot box 10 includes a series of holders 16 that are arranged across interior surfaces of the container 12 in pairs such that each pair of holders (e.g., 16*a* and 16*b* on FIG. 4) face each other across the width of the container 12.

In the illustrated embodiment, the holders 16 are in the general shape of hooks, but it should be understood that no particular shape or grasping mechanism is required for the holders 16. In particular, the holders can be of any shape and/or size and need be configured only to grasp and hold a membrane end during use of the dot blot box. For instance, and without limitation, holders 16 can encompass hooks, clips, coils, pinchers, pins, or any other suitable mechanism for retaining an end of a membrane strip as discussed further herein. The holding mechanism can be any sort that can prevent the test strips from separating from the holder when submerged during use as described further herein.

The holders 16 can be formed of any suitable material that is inert to the materials and reagents expected to be used with a device. For instance, holders can be formed of a suitable plastic, glass, or metal. Depending upon expected use, coated or galvanized steel can be utilized in forming holders 16. In one embodiment, aluminum holders may be preferred, as aluminum is resistant to corrosion by most protein blotting reagents and also affords an amount of malleability that may prove useful in positioning testing strips within the container 12 during use.

The holders 16 can be retained in the container 12 according to any construction. For instance, the holders 16 can be adhered to a wall of a container 12 as illustrated in the figures. In this embodiment, adhesive can generally be located so as to be above the surface of any liquids that will be held in the container 12 during use of the dot blot box, so as to avoid any potential contamination issues. Alternatively, the holders 16 can be integral with a wall of a container (e.g., formed in the walls themselves), attached to the base of the container 12, or hung over the upper edge of a wall, optionally in conjunction with a permanent or temporary adhesion to the walls. In one embodiment, the holders 16 can be secured to a wall of the container 12 at or near the top of the container 12 with a non-toxic, non-reactive adhesive. Securing the holders 16 at or near the top of the container can diminish the likelihood of interaction between the adhesive and a reagent of the process (e.g., a blocking buffer).

The container 12 can be of any useful size so as to hold a plurality of membrane test strips separated from one another and below the surface of a liquid held in the container 12. For instance, a container 12 can be about 10 centimeters or more on a side (e.g., from about 10 cm to about 30 cm in some embodiments) and have a depth of about 5 cm or more (e.g., from about 5 cm to about 10 cm in some embodiments).

The holders 16 can be located in the container 12 so as to retain a plurality of test strips, each being held between a pair of holders. The dot blot box 10 can be sized to retain a plurality of test strips without contact between adjacent test strips and without contact between a test strip and the base of the container. For instance, a container 12 can be sized to retain about 5 or more test strips at one time, for instance have from about a 5 to about a 15 test strip capacity, or from about a 7 to about a 10 strip capacity in some embodiments.

Figure 5:
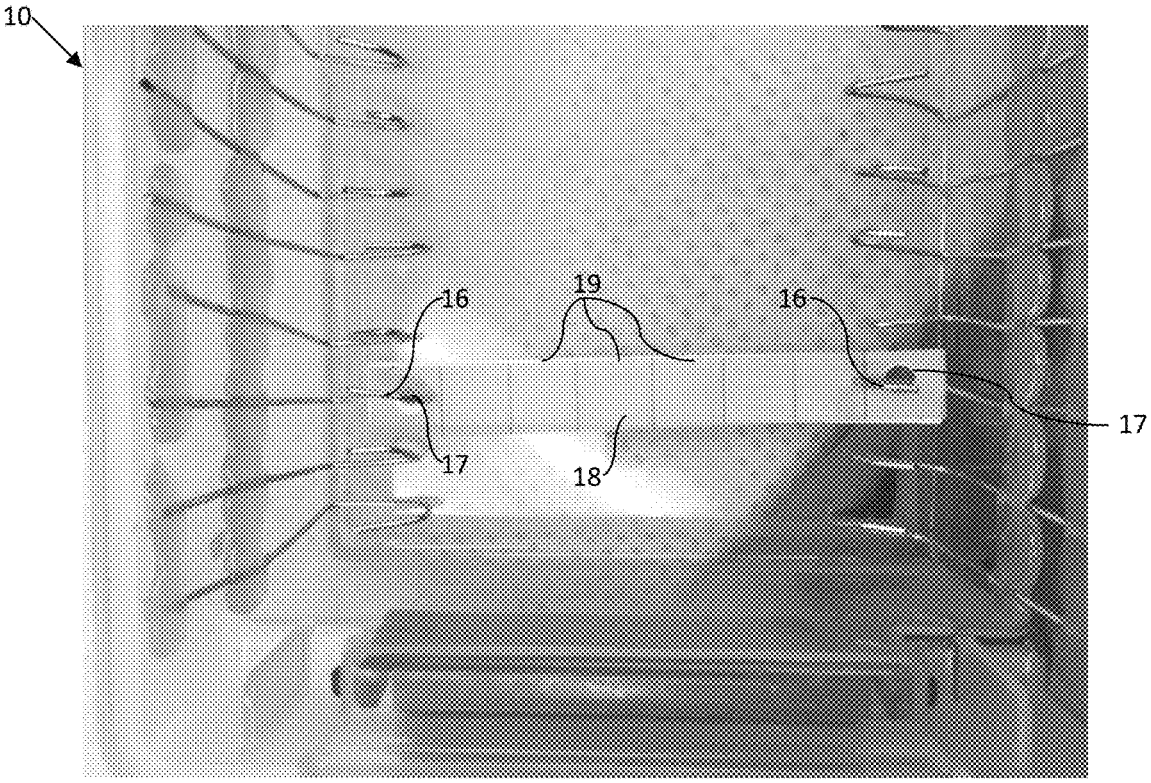
FIG. 5 is a top view of a dot blot box including a marked test strip.
Figure 6:
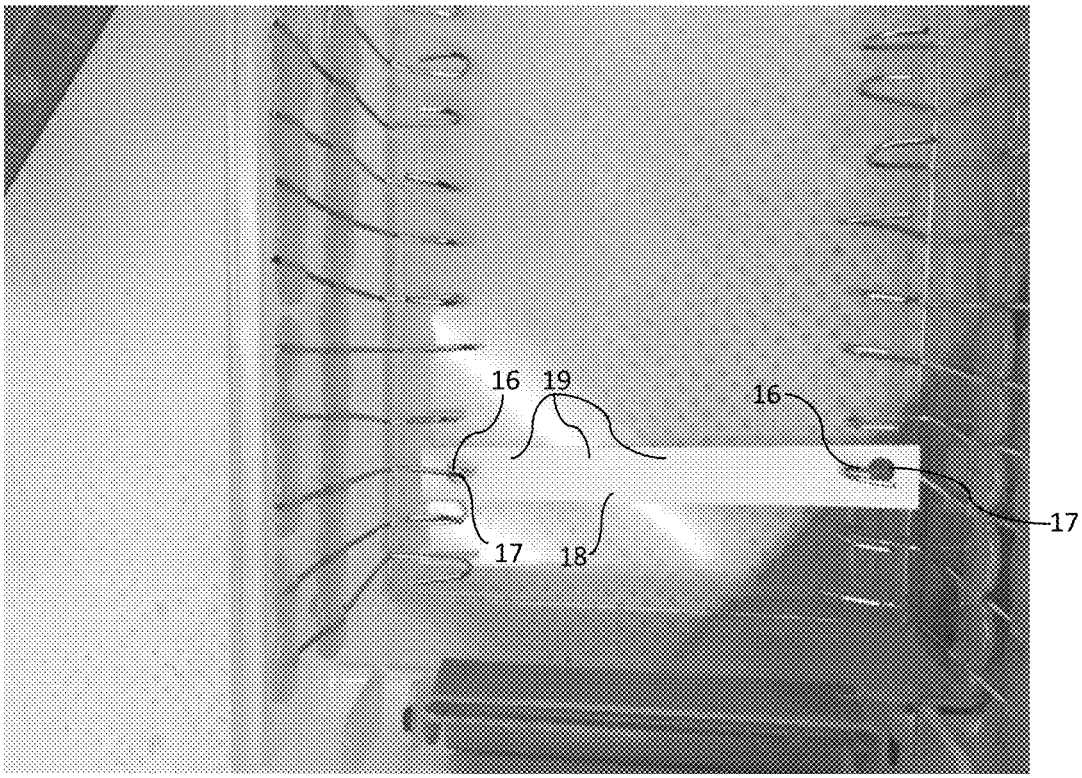
FIG. 6 is a top view of the dot blot box of FIG. 5 following removal of a protective layer from the test strip.

FIG. 5 and FIG. 6 illustrate a dot blot box with a test strip 18 retained between a pair of holders 16. The dot blot box 10 can be utilized with test strips formed of any material as is generally known in the art. For instance, protein blocking membranes such as those formed of nitrocellulose or polyvinylidene fluoride (PVDF) membranes can be used, though a system is not limited to these materials.

The test strip 18 can be modified prior to use with the dot blot box. For instance, in the illustrated embodiment in which the holders 16 are in the form of hooks, the test strip 18 can be modified to include apertures 17 at either end of the test strip 18 that are used to retain the test strip 18 on the holders 16 as shown.

Depending on the dimensions of the dot blot box and the size of the membrane, an initial membrane sheet can be cut to provide a series of test strips of a desired size for location in the box. For instance, a single test strip 18 can be cut from a larger membrane sheet to a size of from about 1.0 to about 2 cm in width and from about 12 to about 15 cm in length, depending upon the size of the container 12. A test strip 18 can also be marked to divide the length of the test strip into separate divisions, each of which can be of a size to contain a single sample dot.

Membranes used in testing protocols generally include a protective cover sheet, and this cover sheet can be used in one embodiment to size the test strips and mark separate divisions on a test strip. As such, the stylus used to mark the test strips need not come in contact with the membrane itself. Rather, by applying force to a cover sheet, the stylus point can indirectly mark the underlying test strip (e.g., the nitrocellulose membrane test strip). For example, FIG. 5 illustrates a test strip 18 in which apertures 17 have been formed in either end that can be used to retain the strip 18 on the holders 16. The test strip 18 has also been marked on the protective cover sheet with a pen to show separate divisions 19, each of a suitable size for a single sample dot (e.g., about 1 to about 1.5 cm square). FIG. 6 shows the same test strip 18 following removal of the protective cover sheet.

According to one embodiment, a membrane test strip can be prepared for a testing protocol by marking a strip (still including in its protective cover sheet) with a series of divisions and optionally labeling one (or more) of the blocks/divisions on the strip. The protective cover sheet can then be removed, and the strip can be placed atop clean, flat, dry substrate (e.g., paper towels optionally covered with filter paper). The markings from the pen will still be visible as indentations on the surface of the test strip. One or more of the divisions can then be dotted with a sample solution of interest, generally in an amount per dot of about 5 μL or less.

Figure 7:
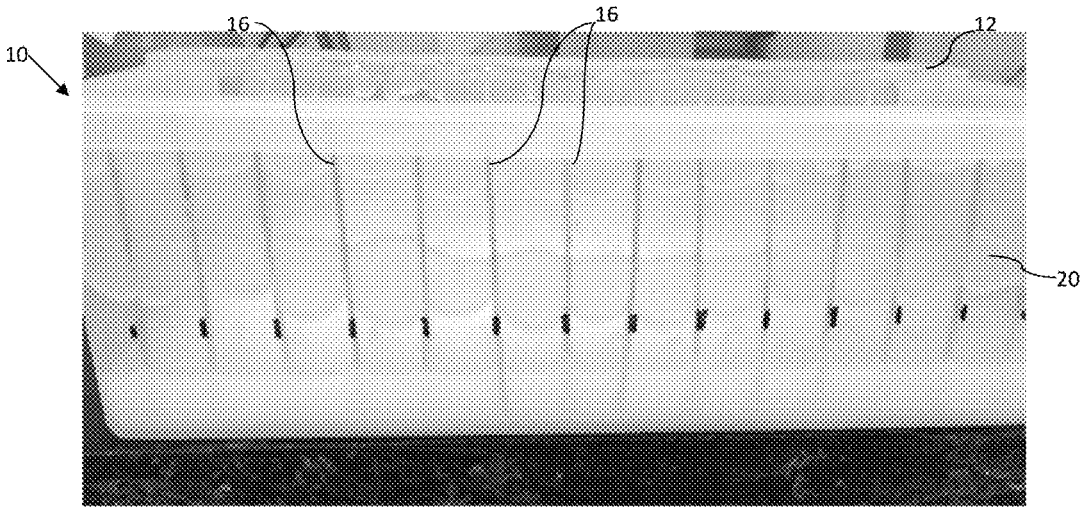
FIG. 7 illustrates a dot blot box including a blocking buffer solution.

During use, a dot blot box can be filled with a reagent liquid (e.g., a 5% blocking buffer) to a depth that can submerge a strip retained between the holders (e.g., about 1.0 cm or more above the base of the container). FIG. 7 illustrates a dot blot box 10 including a container 12 and holders 16 following fill with a liquid 20 for use during a protocol. If the dot blot box is not necessarily used immediately upon filling, and it can be stored (e.g., at 4° C.) prior to use as well as between steps.

Following placement of a sample dot in a designated division of a test strip (when such divisions are included) and after the blot has dried (e.g., for approximately 10 minutes), the dot blot box can be retrieved from cold storage (if necessary) and the test strip 18 can be retained by the holders (e.g., looped over the hooks as shown in FIG. 6) inside the container. If necessary, the container can be gently shaken to fully submerge the sample dots into the liquid. In addition, a tilter or shaker may be used to effectively minimize the amount of reagent required for treatment while ensuring equal exposure of all test strips to said reagent.

Beneficially, the dot blot box allows for the addition of test strips individually to the container without harm to other test strips, while the holders can prevent overlap between adjacent test strips. This can ensure that each test strip is exposed equally to the reagents used in an immunodetection protocol and can thereby produce consistent, easily-imaged results while using relatively small amounts of reagent.

Dot blot boxes disclosed herein can provide for the relative simplicity of protein block at lower cost than traditional dot blotting methods and can save time and resources while offering an avenue for observation that is not impaired by the presence of potential therapeutic compounds. In addition, the dot blot boxes can facilitate the observation of the presence of protein and/or multiple protein structures present in a sample and, therefore, can be an extremely useful tool in research.

The present disclosure may be better understood with reference to the Example set forth below.

EXAMPLE

The following contains an example of a time-course study that employed the dot blot box for accurate sample detection and quantification. Aggregations containing 20 μM of purified amyloid-β monomer, 150 mM NaCl (to enhance aggregation), and optionally an inhibitor (concentrations of inhibitors varied) were mixed into 40 mM Tris-HCl buffer.

An initial, traditional protocol was carried out in which 2 μL of the mixture was dotted onto a single nitrocellulose membrane (0.2 μm pore size) to form multiple sample dots. The samples air-dried over the length of the aggregation (anywhere from 4-10 hours) at 25° C./room temperature and were subsequently placed into 5% blocking buffer for 1 hour at 25° C. or overnight at 4° C. prior to imaging. Blots were probed with LOC antibody, a structure-specific antibody that recognizes and binds to amyloid fibrils; or 6E10, a sequence-specific antibody whose epitope lies in amino acids 3-8 of amyloid-β (EFRHDS) to bind both monomeric and fibrillary protein, for 1 hour.

Figure 8:
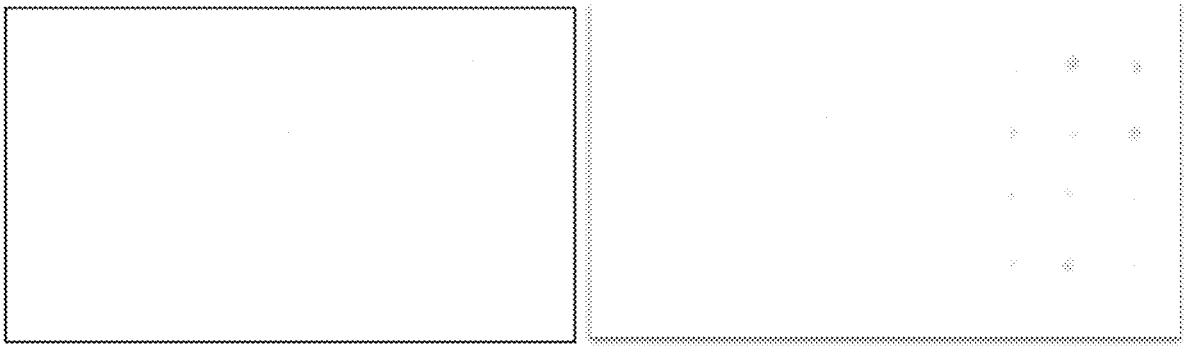
FIG. 8 presents dotting results for determination of amyloid-β protein, a protein relevant in Alzheimer's disease, using the sequence-specific 6E10 antibody whose epitope lies in amino acids 3-8 of amyloid-β (left) and LOC antibody, a structure-specific antibody that recognizes and binds to amyloid aggregates (right) by traditional dot blotting methods.

Blots were washed in 1×PBST (pH 7.4) and treated with the appropriate secondary antibody for 45 minutes. After washing, a chemiluminescent agent was added to the blots and allowed to react for 2 minutes, after which time the blots were imaged. Results for both the 6E10 antibody (FIG. 8, left) and the LOC antibody (FIG. 8, right) were inconsistent and often difficult to visualize.

The faintness of the initial time points on the LOC blot was expected, as it takes time for the fibril structures that serve epitopes for the LOC antibody to form; however, 6E10 is sequence-specific and should bind to its epitope regardless of the structure or aggregate (unless the protein conformation masks or blocks that epitope). Because of the consistent observation that the 6E10 dot blots were almost absent on every time point but the last 2 (regardless of the time of the overall experiment or aggregation), it was hypothesized that the drying time negatively impacted the results of the dot blots.

To test this, a second protocol was conducted in which monomer from the same sample was blotted onto 2 membranes every 15 minutes; one membrane was placed immediately into blocking buffer once the blot appeared to be dry (approximately 5 minutes), while the other was air-dried per the previous protocol.

Figure 9:
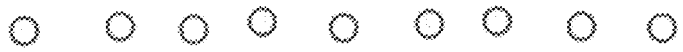
FIG. 9 presents results for determination of the presence of amyloid-β via 6E10 antibody in which points were allowed to air-dry throughout aggregation.
Figure 10:
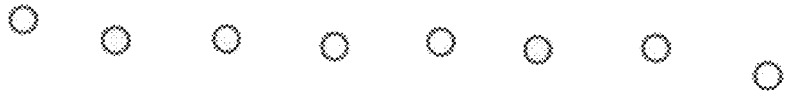
FIG. 10 presents results for determination of the presence of amyloid-β via 6E10 antibody in which points were placed in blocking buffer immediately after blotting.

Although the air-dried blot would be exposed to air for much less time overall than the time usually required for an aggregation, it was speculated that there would be significant enough difference to confirm whether this was one source of the problems occurring with the blots in the initial protocol. The results following probing with 6E10 antibody are shown in FIG. 9 and FIG. 10. Upon comparison of the images, it was noted that the air-dried points (FIG. 9) were much lighter at the initial time points than those blocked immediately after blotting (FIG. 10).

As shown, the second protocol demonstrated some improvement over the first protocol, but the results were still significantly lighter than what was expected or ideal.

A third protocol was conducted using a dot blot box as described herein. A dot blot box was filled with the 5% blocking buffer solution to reach 1.0 cm above the bottom of the container (FIG. 7). The dot blot box containing the blocking buffer solution was then stored at 4° C.

Figure 11:
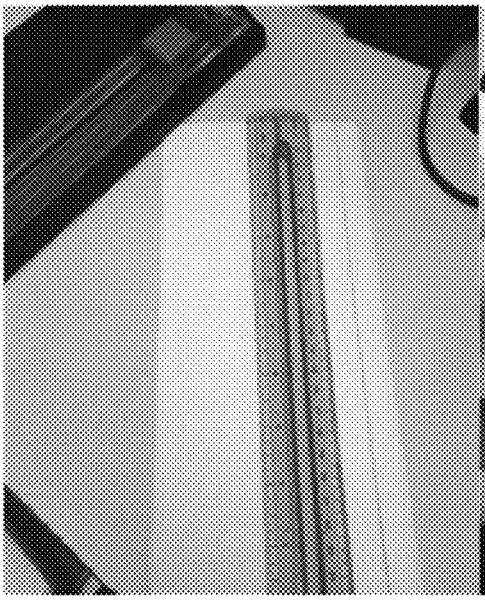
FIG. 11 illustrates the measuring of the membrane, a step in formation of a test strip for use with the dot blot box.
Figure 12:
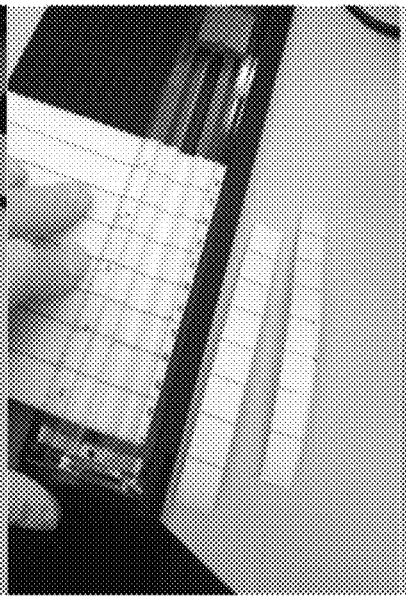
FIG. 12 illustrates the cutting of the measured membrane into strips, another formation step of a test strip.
Figure 13:
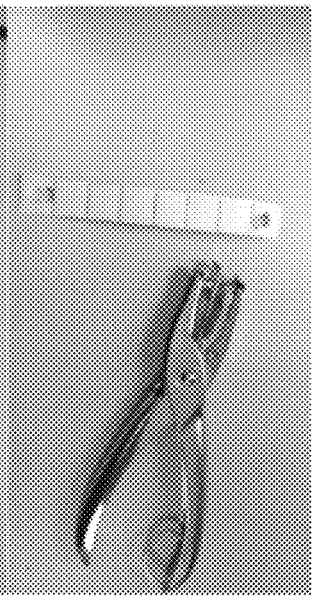
FIG. 13 illustrates punching a hole at opposing ends of the membrane strip to enable easy placement of the strips on hooks within the dot blot box, another formation step of a test strip.

The membrane as purchased was modified to form a plurality of test strips. Initially, a ballpoint pen was used to make indentions in 12 cm×30 cm piece of the 0.1 μm nitrocellulose membrane while still encased within the protective paper membrane to create 1.5 cm divisions along the length (FIG. 11), and then cut using a paper cutter along its width to produce strips approximately 1.0 to 1.5 cm wide (FIG. 12). Each strip had the final dimensions of 12 cm length×1.0 to 1.5 cm wide, with 6 marked divisions on the strip. A single hole-punch was used to punch holes in the divisions at the ends of each strip (FIG. 13).

To prepare a sample at a time point a single strip still encased in the protective paper was labeled (FIG. 14). The protective layer was then removed and the strip placed on a work area (FIG. 15) and dotted with 4 μL dots of the protein solution (FIG. 16). The blots were allowed to dry for 10-15 minutes (FIG. 17) per recommendation of the membrane provider. Following drying, a test strip was placed over the hooks in the box (FIG. 18) and the box was gently shaken to submerge each strip. The box was returned to cold storage at 4° C. following placement of each strip in the box.

Figure 19:
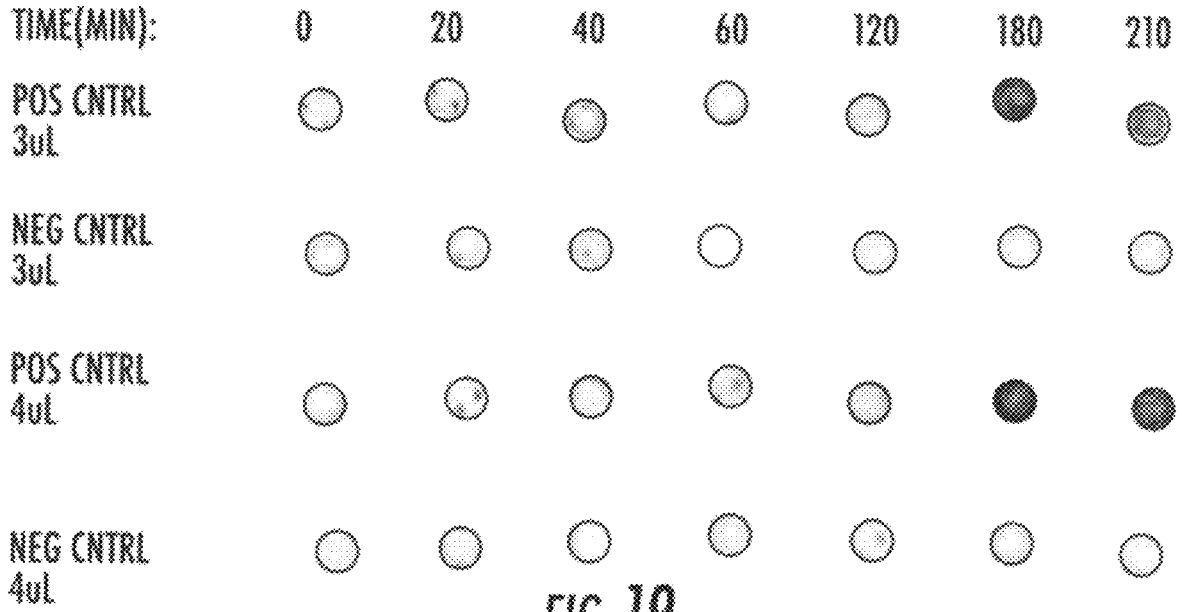
FIG. 19 presents dot blot results using a dot blot box as disclosed upon probing amyloid-β dots with 6E10 antibody.
Figure 20:
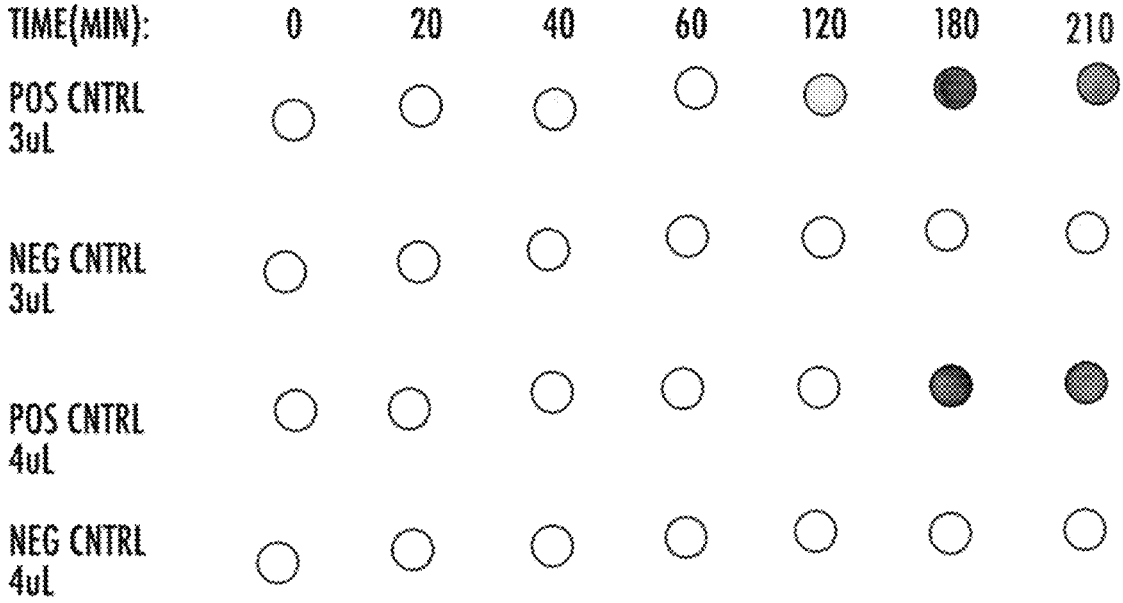
FIG. 20 presents dot blot results using a dot blot box as disclosed upon probing amyloid-β dots with LOC antibody.

The following day, the blots were probed with 6E10 or LOC antibody. Results are shown in FIG. 19 (6E10) and FIG. 20 (LOC). As shown, results were much improved over the first and second protocols.

While certain embodiments of the disclosed subject matter have been described using specific terms, such description is for illustrative purposes only, and it is to be understood that changes and variations may be made without departing from the spirit or scope of the subject matter.

What is claimed is:

1. A dot blot box comprising:

a container comprising a first end wall having a first surface and a second end wall having a second surface, the first and second surfaces facing one another across a base of the container, the container further comprising a first side wall and a second side wall, the first and second side walls facing one another across the base of the container, the container defining a container interior surrounded by a perimeter that comprises the first and second end walls and the first and second side walls;

a first series of holders adjacent to one another and spaced along a first uninterrupted length of the first surface, each holder of the first series comprising a hook, each hook being configured to pass through an aperture of a test strip and thereby retain a first end of the test strip above the base of the container; and a second series of holders adjacent to one another and spaced along a second uninterrupted length of the second surface, each one of the first series of holders being paired with and located across the base from one of the second series of holders, each holder of the second series comprising a hook, each hook being configured to pass through an aperture of a test strip and thereby retain a second end of the test strip above the base of the contains, such that each pair of the holders is configured to retain a single test strip and the first series of holders and the second series of holders are configured to retain a plurality of test strips in a non-contact arrangement adjacent to one another and within the container interior.

2. The dot blot box of claim 1, wherein the container comprises a plastic or a glass.

3. The dot blot box of claim 1, wherein the holders comprise a plastic or a metal.

4. The dot blot box of claim 3, wherein the metal comprises aluminum.

5. The dot blot box of claim 1, wherein the first and second end walls are each about 5 centimeters or more in height and about 10 cm or more in length.

6. A method for carrying out a protein blocking protocol, comprising:

contacting a first test strip with a first test sample, the first test sample comprising a protein;

retaining the first test strip within a container by use of a first holder and a second holder, the first test strip having a length that extends from the first holder to the second holder, the first holder comprising a first hook and the second holder comprising a second hook, wherein the first test strip is retained by passing the first hook through a first aperture of the first test strip and by passing the second hook through a second aperture of the first test strip;

submerging the first test sample held on the first test strip in a solution retained in the container;

contacting a second test strip with a second test sample;

retaining the second test strip within the container by use of a third holder and a fourth holder, the second test strip having a length that extends from the third holder to the fourth holder, the third holder comprising a third hook and the fourth holder comprising a fourth hook, wherein the second test strip is retained by passing the third hook through a first aperture of the second test strip and by passing the fourth hook through a second aperture of the second test strip; and submerging the second test sample held on the second test strip within the solution retained in the container; wherein the first and second test strips are retained adjacent to one another within a single container interior surrounded by a perimeter of the container without contacting one another and without contacting a base of the container.

7. The method of claim 6, wherein the solution is a blocking buffer solution.

8. The method of claim 6, wherein the first test sample is applied in a designated division of the first test strip.

9. The method of claim 6, the method comprising contacting the first test strip with a plurality of dots of the first test sample.

10. The method of claim 6, wherein the second test strip is contacted with the second test sample following a first period of time after contacting the first test strip with the first test sample.

11. The method of claim 10, further comprising storing the dot blot box for a second period of time following retaining of the first test strip by the first and second holders and prior to retaining the second test strip by the third and fourth holders.

12. The method of claim 6, further comprising following the step of submerging the first test sample, probing the first test sample with a first antibody.

13. The method of claim 12, further comprising following the probing of the first test sample with the first antibody, probing the first test sample with a second antibody.

14. The method of claim 6, further comprising imaging the first test sample.

* * * * *